US007621160B2

(12) United States Patent
Thomson et al.

(10) Patent No.: US 7,621,160 B2
(45) Date of Patent: Nov. 24, 2009

(54) LOCKING BAG WITH LOCKING HANDLE

(76) Inventors: Mary Thomson, 22 Sterling Way, North East, MD (US) 21901; Ann L. Keller, 5961 Captain Major Ave., Bensalem, PA (US) 19020; Kathleen Parisi, 6391 Neshaminy Valley Dr., Bensalem, PA (US) 19020

( * ) Notice: Subject to any disclaimer, the term of this patent is extended or adjusted under 35 U.S.C. 154(b) by 0 days.

(21) Appl. No.: 12/421,595

(22) Filed: May 6, 2009

(65) Prior Publication Data

US 2009/0208145 A1 Aug. 20, 2009

Related U.S. Application Data

(63) Continuation-in-part of application No. 12/135,030, filed on Jun. 6, 2008, which is a continuation-in-part of application No. 11/973,244, filed on Oct. 5, 2007, now abandoned.

(51) Int. Cl.
*E05B 67/38* (2006.01)

(52) U.S. Cl. ..... 70/68; 206/1.5; 150/102

(58) Field of Classification Search ..... 70/64–68; 206/1.5; 150/102
See application file for complete search history.

(56) References Cited

U.S. PATENT DOCUMENTS

| | | | | | |
|---|---|---|---|---|---|
| 1,606,466 | A * | 11/1926 | Currier | 70/64 |
| 3,070,986 | A * | 1/1963 | Hart | 70/68 |
| 3,580,016 | A * | 5/1971 | Kerr | 70/68 |
| 3,653,236 | A * | 4/1972 | Kerr | 70/68 |
| 3,759,073 | A * | 9/1973 | Rifkin | 70/68 |
| 3,785,185 | A * | 1/1974 | Kerr | 70/68 |
| 3,973,419 | A * | 8/1976 | Atkinson | 70/68 |
| 4,213,314 | A * | 7/1980 | Trader | 70/68 |
| 4,249,402 | A * | 2/1981 | Steinbach | 70/68 |
| 4,403,485 | A * | 9/1983 | Scherbing | 70/68 |
| 4,677,833 | A * | 7/1987 | Scherbing et al. | 70/68 |
| 4,744,230 | A * | 5/1988 | Shum | 70/68 |
| 4,792,026 | A * | 12/1988 | Dimmick et al. | 190/101 |
| 4,817,769 | A * | 4/1989 | Saliba | 190/18 R |
| 5,820,267 | A * | 10/1998 | Nobles | 383/97 |
| 7,086,255 | B2 * | 8/2006 | Reason | 70/2 |
| 7,155,881 | B1 * | 1/2007 | McGuire et al. | 53/416 |
| 7,322,476 | B2 * | 1/2008 | Witherspoon | 206/579 |
| 7,367,482 | B1 * | 5/2008 | Witherspoon, Jr. | 224/576 |
| 2002/0148395 | A1 * | 10/2002 | Judge | 109/52 |
| 2006/0016530 | A1 * | 1/2006 | Volk et al. | 150/101 |
| 2006/0016531 | A1 * | 1/2006 | Volk et al. | 150/102 |
| 2006/0016532 | A1 * | 1/2006 | Volk et al. | 150/102 |
| 2007/0240798 | A1 * | 10/2007 | Bihler | 150/102 |
| 2008/0128058 | A1 * | 6/2008 | Bodine | 150/102 |

* cited by examiner

*Primary Examiner*—Suzanne D Barrett
(74) *Attorney, Agent, or Firm*—Douglas J. Ryder; Frank A. Mazzeo

(57) ABSTRACT

A bag comprising a lockable pouch and a lockable handle is disclosed. The bag comprises a locking mechanism that secures the contents of the bag by securing a sliding fastener in place. In one embodiment, the handle and sliding fastener are both secured via a common key-operated mechanism. A handle that is removal at one end allows the handle to be placed around a stationary object as to secure the bag to that object while unattended. A single control is provided conveniently to release both the sliding fastener and the handle. The handle is comprised of a flexible yet strong material, such as a metal cable.

17 Claims, 12 Drawing Sheets

LOCKING BAG WITH LOCKING HANDLE

CROSS REFERENCES TO RELATED APPLICATIONS

This application is a continuation-in-part of U.S. patent application Ser. No. 12/135,030, filed on Jun. 6, 2008, which is continuation-in-part of U.S. patent application Ser. No. 11/973,244, filed on Oct. 5, 2007 now abandoned. U.S. application Ser. Nos. 11/973,244 and 12/135,030 are incorporated herein in their entirety by reference as if set forth at length.

FIELD OF THE INVENTION

The present invention relates generally to apparatus and methods for securing bags and, more particularly, to a bag including a lockable handle.

BACKGROUND

People use several types of bags, handheld bags, handbags or containers for carrying different personal items with them to stores, beaches, pools, schools, hotels and many other locations. Similarly, students use backpacks to carry laptops, books, media players and other items to and from school. Travelers carry cash, credit cards, cameras, passports, mobile phones and other similar items with them when they travel. These bags or containers contain valuable items that the person does not want to lose or have stolen. Therefore, to ensure that the items are not being removed or stolen from the person's bags, the persons must keep the bags with them at all times. In some situations, carrying the bags at all times becomes burdensome and makes some activities almost impossible.

For example, if a person is at a relatively open area such as a pool or beach and the person has a bag such as a beach bag, tote or purse, the person cannot leave their spot at the pool or beach without taking the bag with them for fear that the bag will be stolen or that one or more items from the bag will be stolen or removed by thieves or the like. The person must therefore carry the bag or purse with them to get food, go to the restroom or to perform other activities such as playing volleyball. In addition, if the person wants to go in the water to swim, the person must have another person such as a spouse watch their bag while they are in the water. Otherwise, the person must place the bag as close to the water as possible to keep an eye on the bag. The additional burdens of watching the bag and carrying the bag makes participation in activities or carrying items such as food trays more difficult.

Thieves operate quickly and discretely. Therefore, a bag that is secured and locked to an object or at least secured and locked in a closed position is a less desirable target for a thief because the thief will have to spend too much time and effort to attempt to remove the bag or to remove the items from the bag. Thieves are less likely to want to draw attention to themselves by trying to cut, pry or break into a secured and locked bag to remove the bag or remove the contents of the bag.

To alleviate the need to carry the bag during an activity, it is desirable to stow the bag in a secure manner. Balancing the need for security is also the need for convenience. The prior art bags are lacking in convenience. Therefore, what is desired, is an improved lockable bag that provides both security and convenience in regular use.

SUMMARY

The present invention comprises a bag, having a sliding fastener, such as a zipper, and a handle comprising a strong cable. The bag provides the desired security and convenience by providing a bag that can quickly lock or unlock both the handle and the sliding fastener. The bag may use a plunger mechanism with a lip to lock the sliding fastener. This technique for locking a sliding fastener is known in the industry, and is the subject of U.S. Pat. No. 5,820,267 to Nobles. While this technique is well suited for locking a sliding fastener, it does not serve to lock a handle. The present invention provides a means to lock both the handle and the sliding fastener. The user may elect to lock the sliding fastener, the handle, or both, depending on the situation. For example, when carrying the bag, it may be desirable to lock the handle, but leave the sliding fastener unlocked for convenient access to the items contained within the bag. When leaving the bag unattended, it may be desirable to lock both the handle and the sliding fastener to secure the bag, as well as its contents. The handle may be arranged about an object to secure the bag to that object. For example, the handle may be secured around a rail, such as that provided by a fence post, to secure the bag to that rail while it is left unattended. The bag may be secured to a variety of stationary or non-stationary objects, including, but not limited to, a tree, a picnic table, beach umbrella, lounge chair, office desk, baby stroller and shopping cart, to name a few. With the bag of the present invention, the user is able to "lock and leave" the bag and enjoy time with family and friends.

One embodiment of the bag of the present invention includes a unique locking mechanism which secures both a zipper as well as the bag. This embodiment uses a seven pin tumbler, a ⅛" galvanized coated cable and a liner resistant to cutting and gouging, which makes the bag almost impossible to penetrate by ordinary means. The water-resistant material allows the contents of the bag to remain dry. The design of the zipper/cable locking mechanism is such that the zipper of the bag can remain unlocked allowing easy access to belongings while still maintaining the look of the bag with the shoulder strap in a locked configuration. A bag according to the present invention is well suited for secure transporting of valuables such as cash, credit cards, passports, mobile phones, cameras, computers and media players.

The applications for the bag of the present invention are practically limitless, and include but are not limited to the following: vacation and business travel, water activities, children's activities including sports activities, shopping, activities involving babies, work, school and dorm room security and laptop security. These advantages, and others, will be apparent from the following detailed description.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1A:
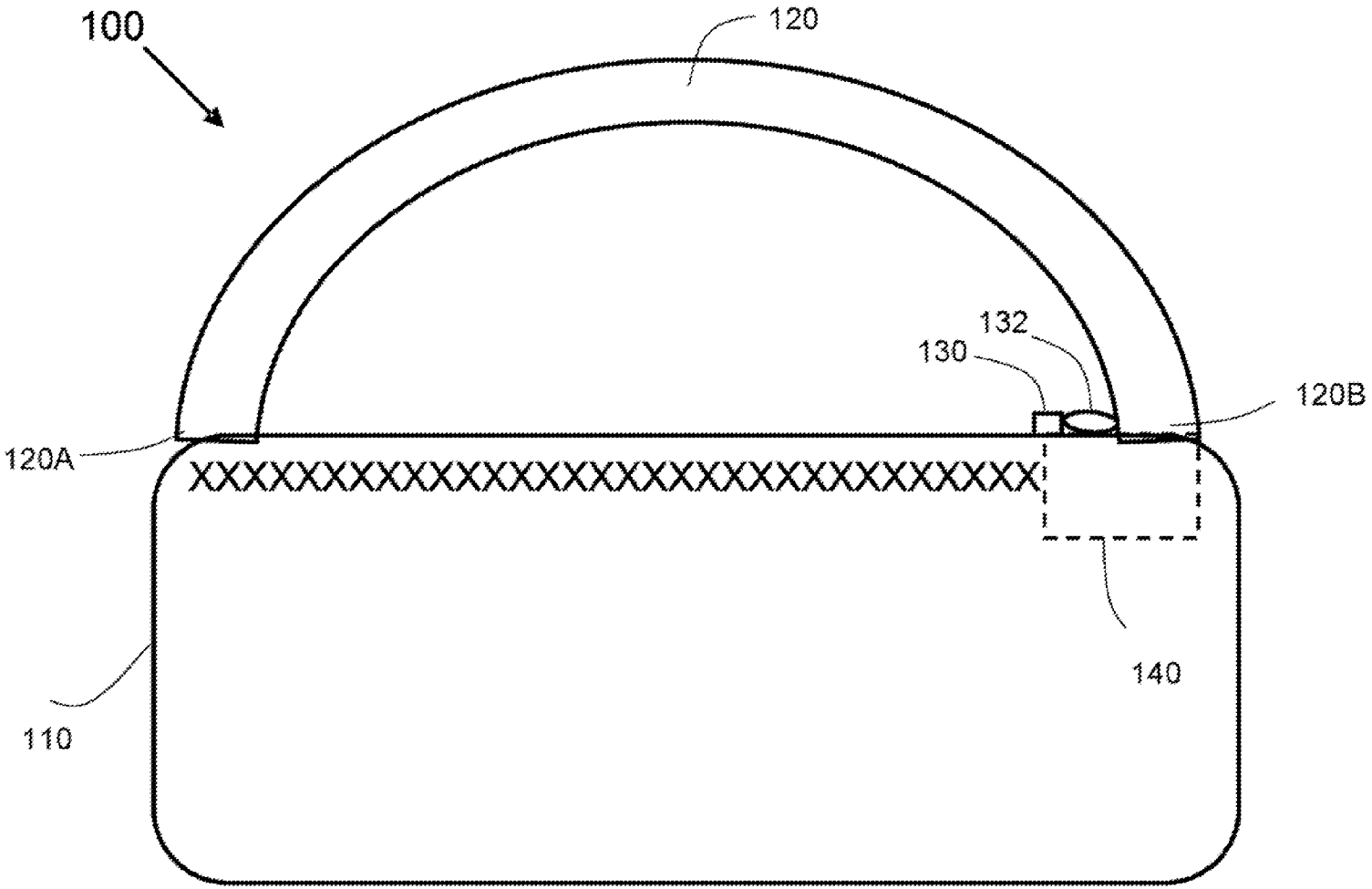

In the drawings accompanying the description that follows, in some cases both reference numerals and legends (labels, text descriptions) may be used to identify elements. If legends are provided, they are intended merely as an aid to the reader, and should not in any way be interpreted as limiting.

Figure 2A:
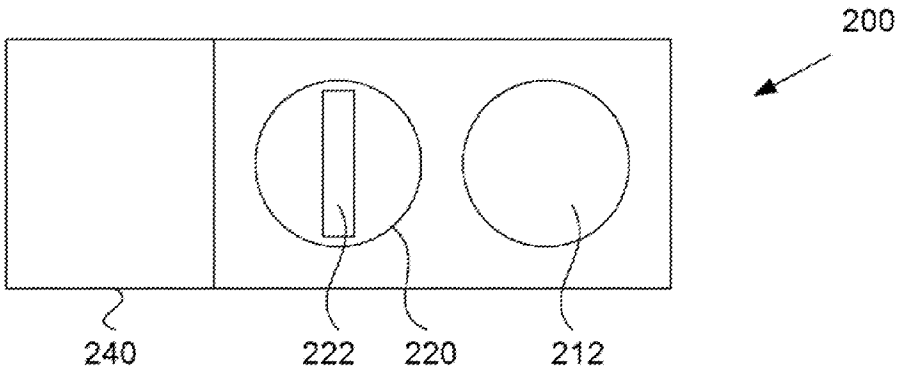
Figure 2B:
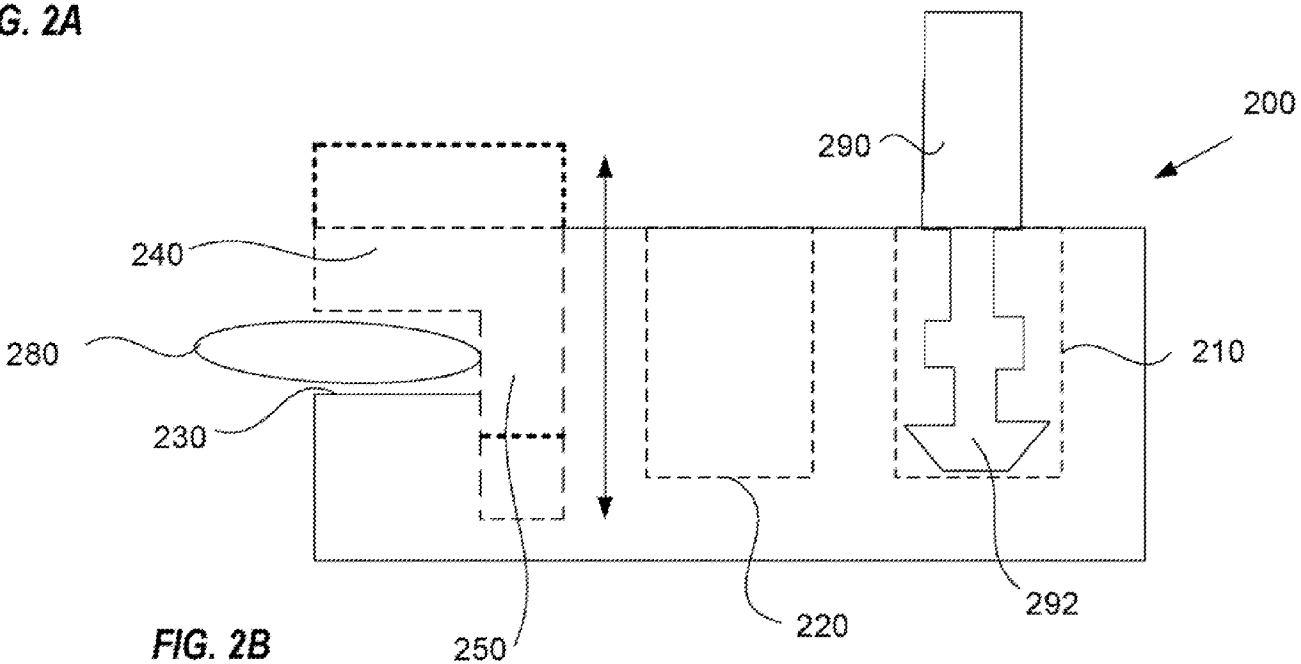
Figure 3A:
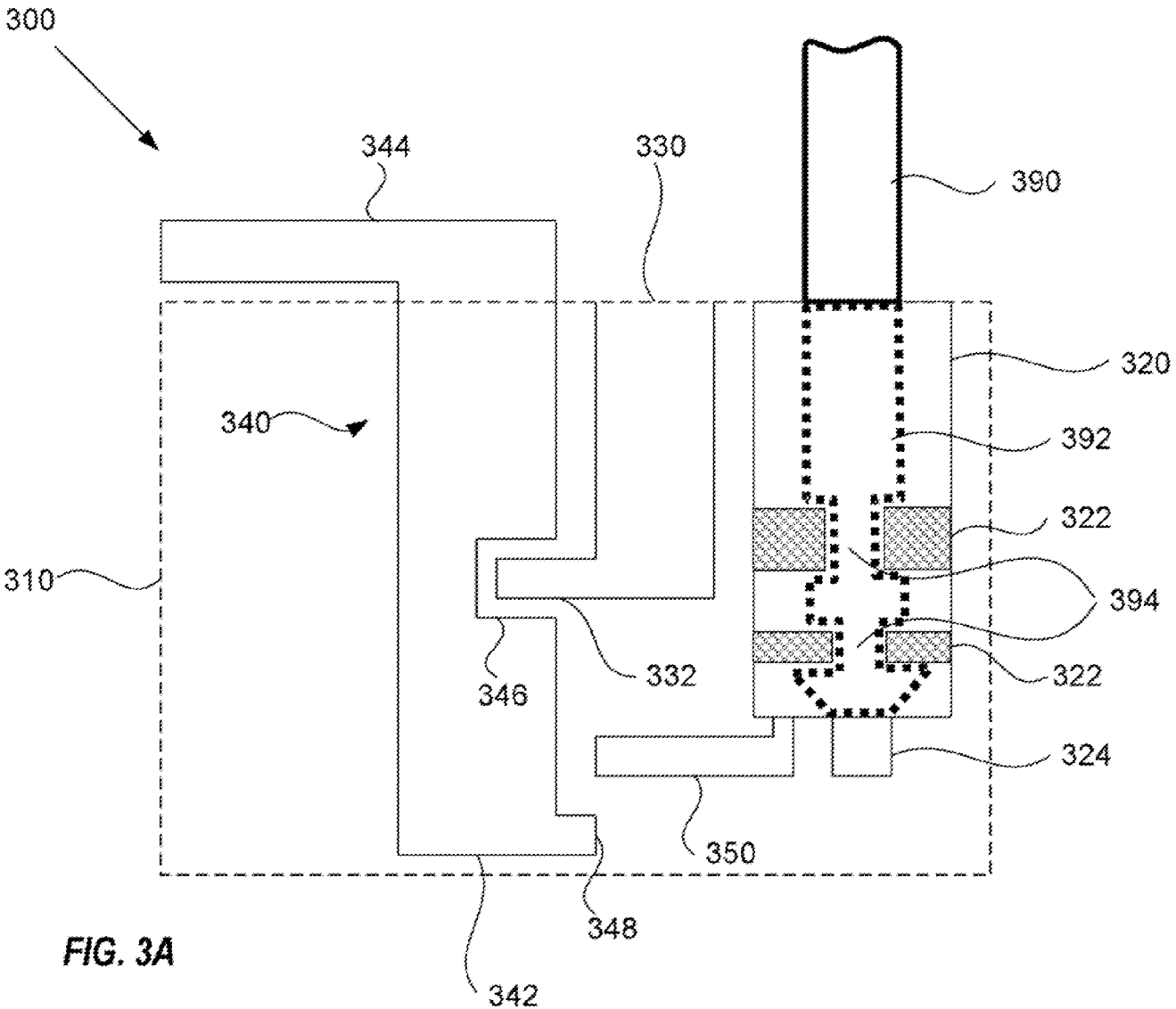
Figure 3B:
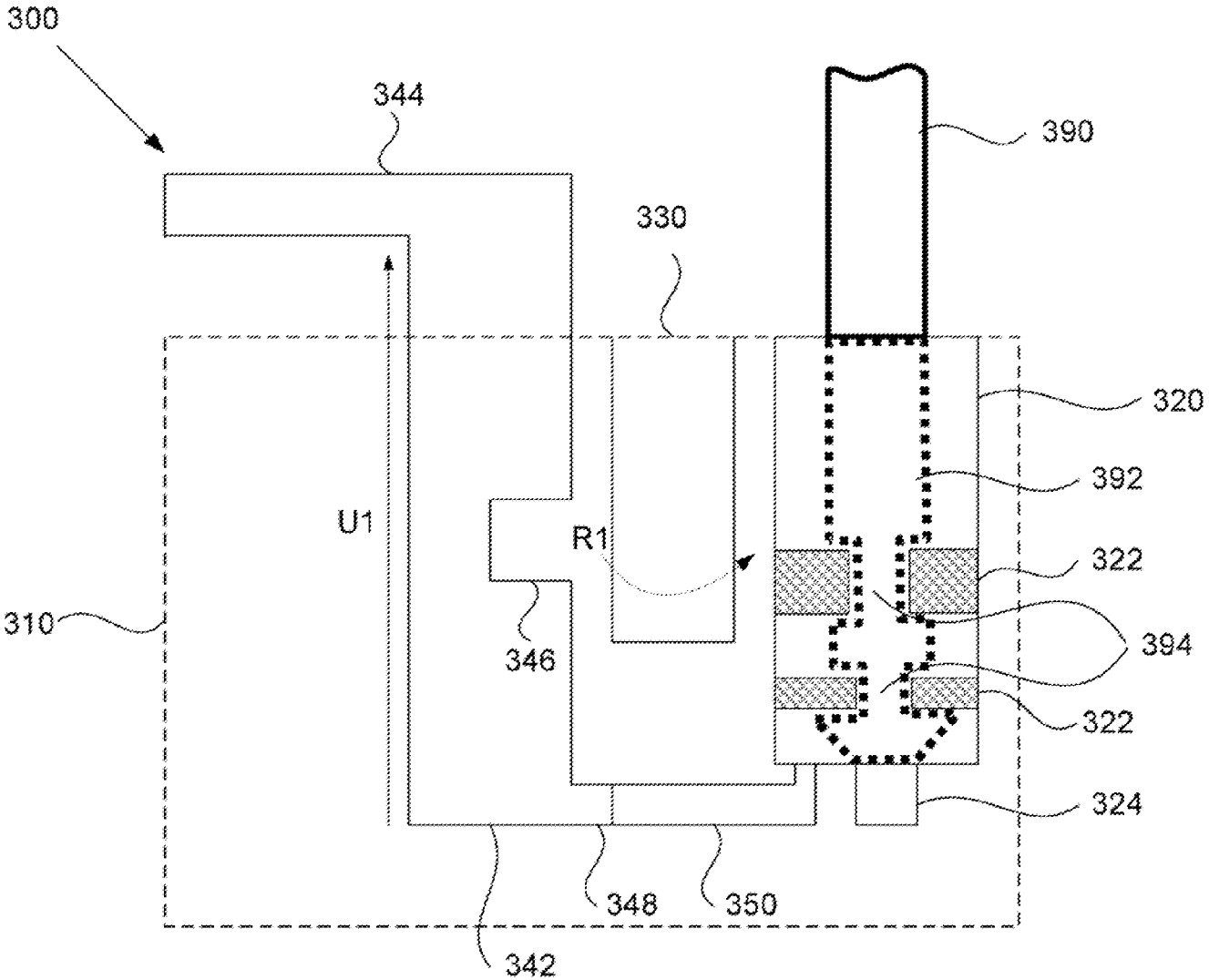
Figure 3C:
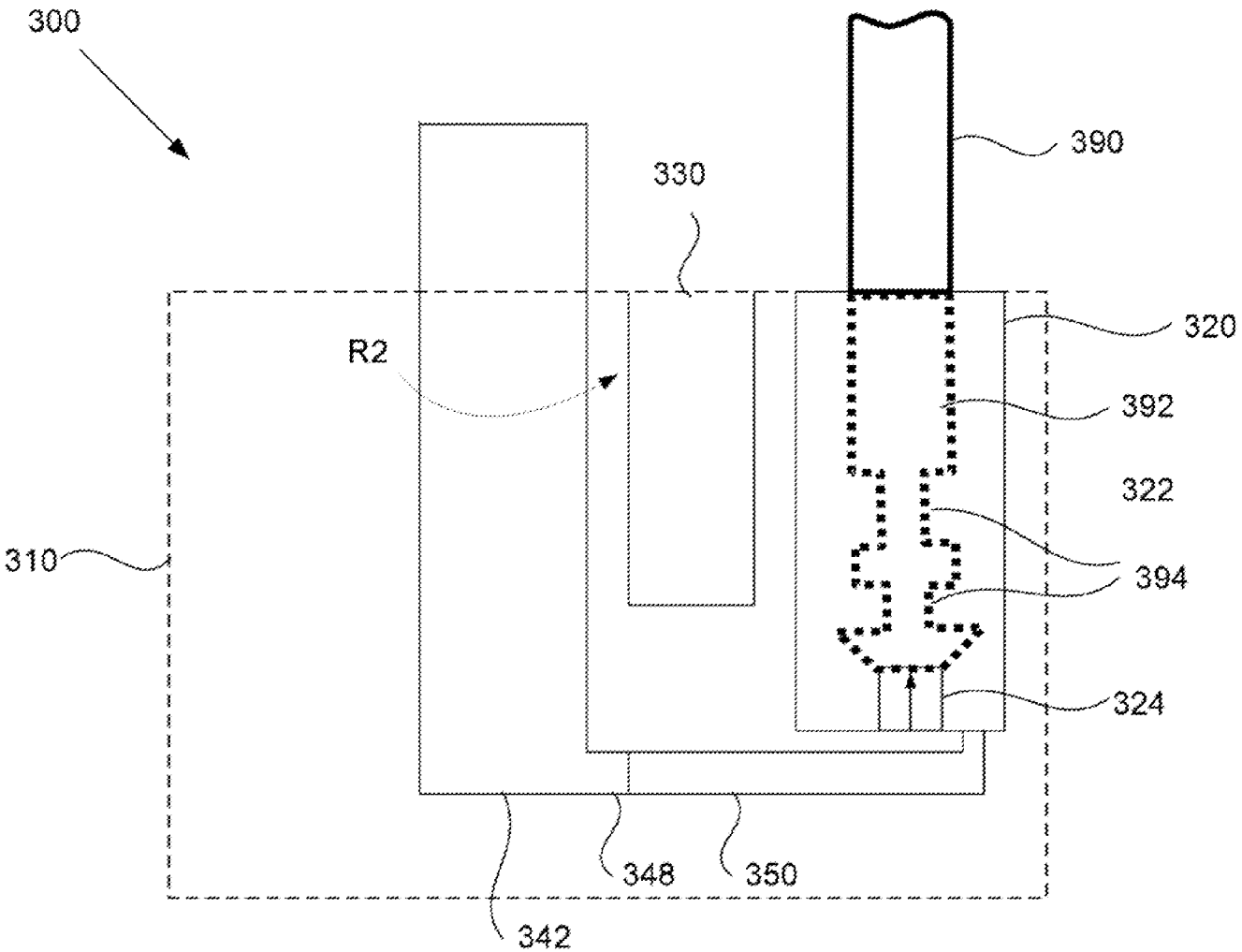
Figure 4:
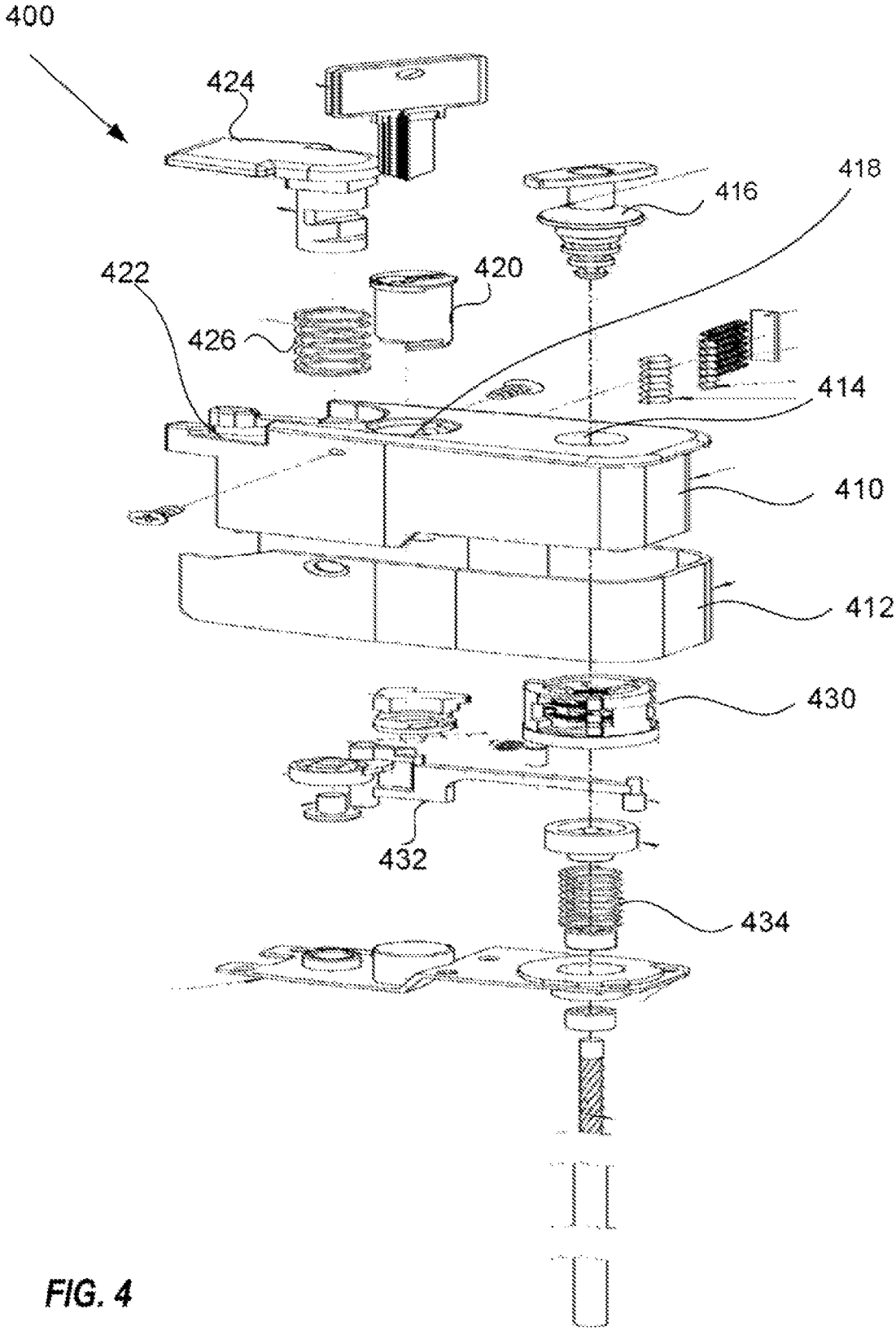
Figure 5:
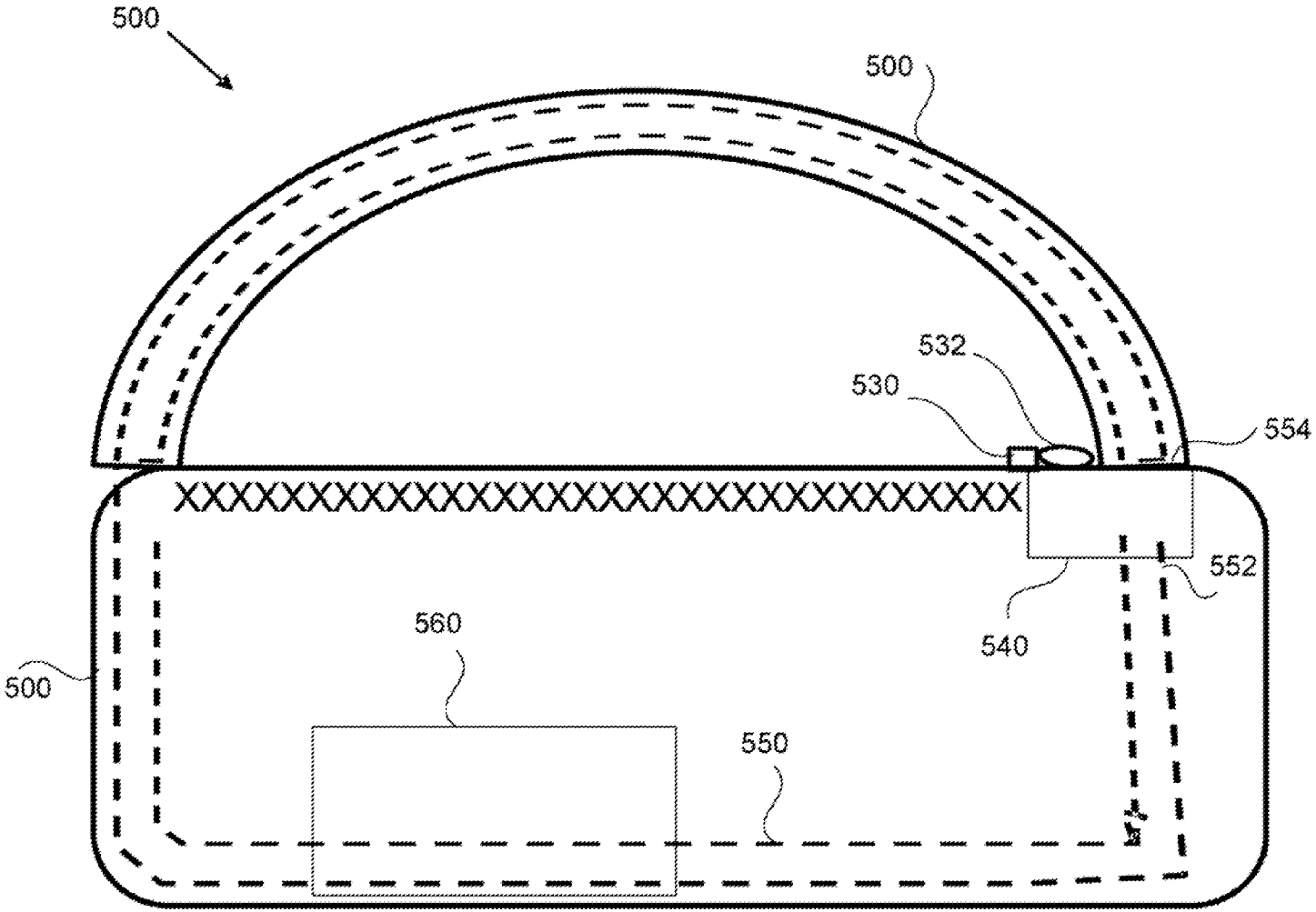
Figure 6B:
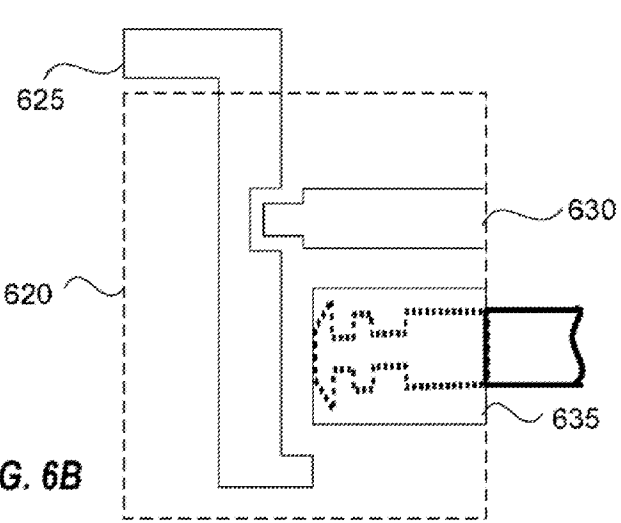
Figure 6A:
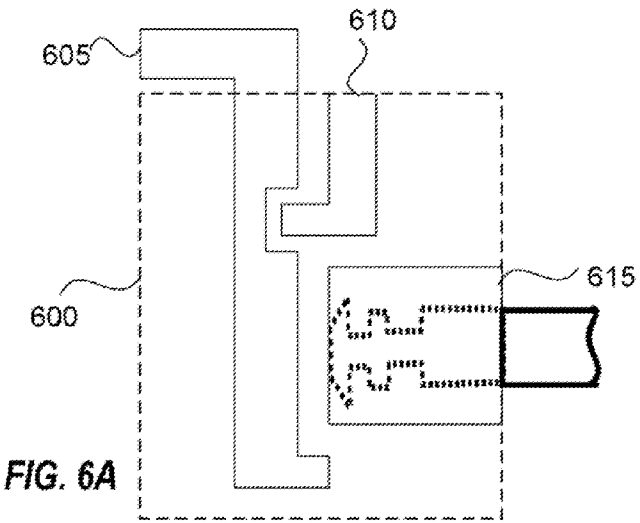
Figure 6C:
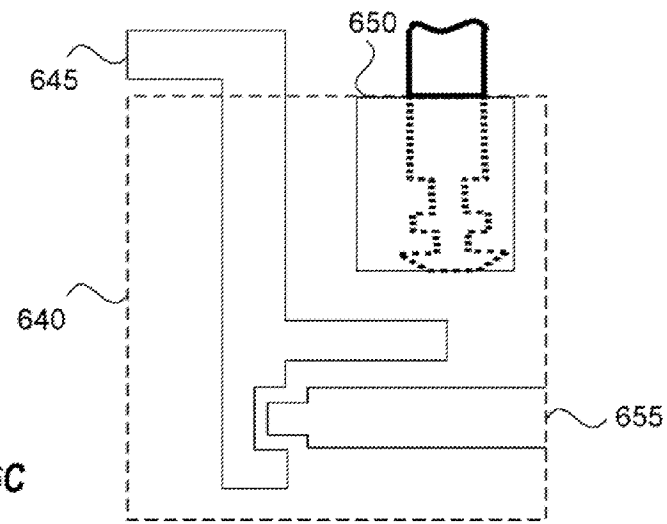
Figure 7:
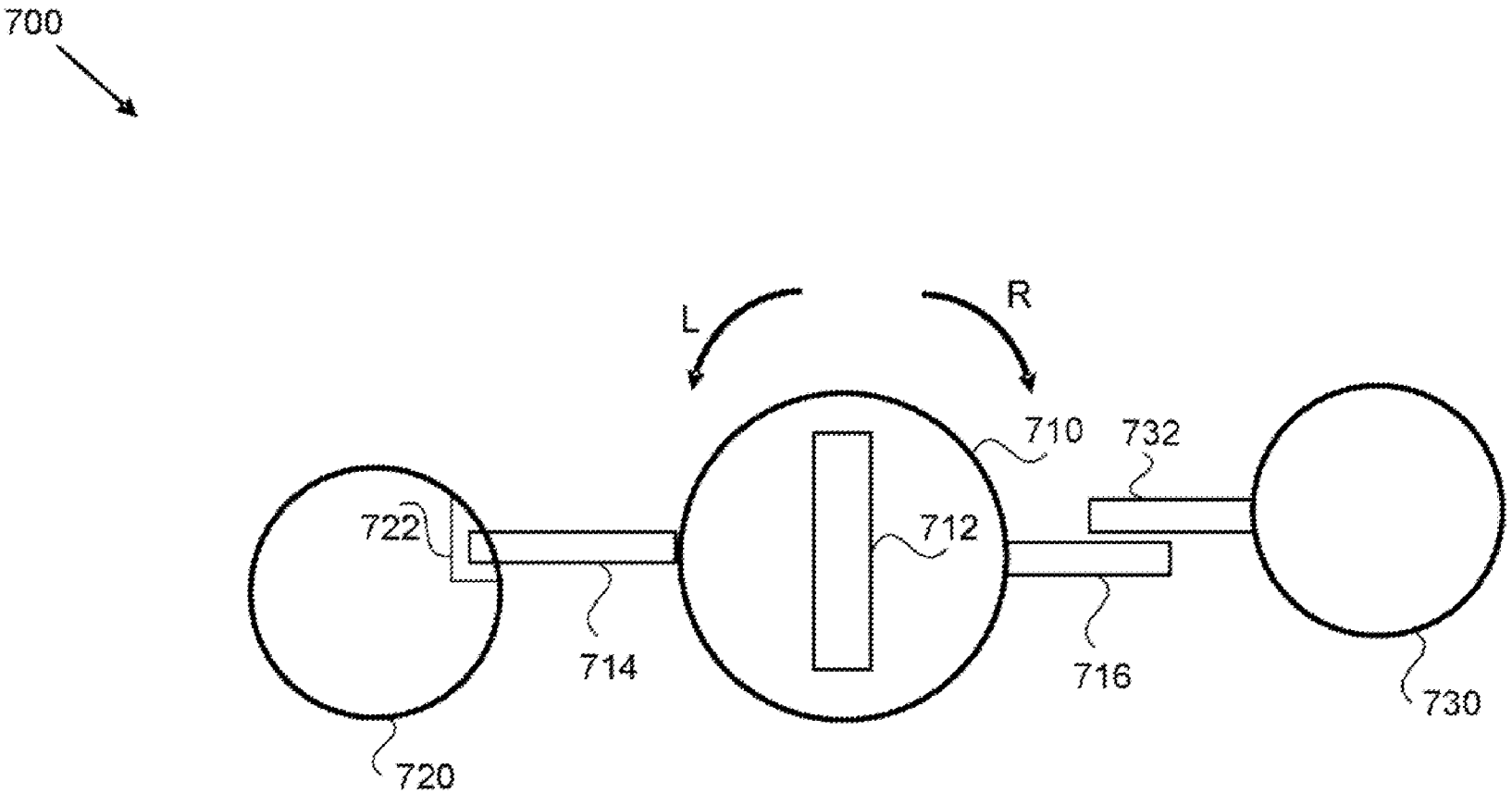

FIG. 1A-D illustrate side views of an example locking bag in various configurations, according to one embodiment;

FIGS. 2A-B illustrate a simplified top and side view of an example locking mechanism, according to one embodiment;

FIGS. 3A-C illustrate a series of cross-sectional views of an example locking mechanism in use, according to one embodiment;

FIG. 4 illustrates an exploded view of an example locking mechanism, according to one embodiment;

FIG. 5 illustrates a side views of an example locking bag in a locked configuration, according to one embodiment;

FIGS. 6A-C illustrate cross-sectional views of example locking mechanisms, according to one embodiment; and FIG. 7 illustrates a top cross-sectional view of an example locking mechanism, according to one embodiment.

DETAILED DESCRIPTION

FIGS. 1A-D illustrate side views of an example locking bag 100 in various configurations. The locking bag 100 includes a main body 110 and a handle 120. The main body 110 forms at least one compartment (not illustrated) for holding contents. The main body 110 may be made of a material that is resistant to cutting and gouging, such as a Kevlar material. The main body 110 may be made of a material that is water-resistant, such as a water-resistant polyester fabric. The main body 110 includes an opening (not illustrated in the side view) to allow entry thereinto, for example, to place contents in or remove contents from. The main body 110 may include one or more interior pockets (not illustrated) and/or one or more exterior pockets (not illustrated). The one or more interior/exterior pockets may be made of a water-resistant material, providing contents contained therein protection from water damage.

The handle 120 may be made of a strong, yet flexible material (e.g., a metal cable). According to one embodiment, the handle 120 may include a galvanized steel cable that is coated with plastic, or is disposed within a fabric sleeve (not illustrated). According to one embodiment, a cable having a ⅛ inch diameter may be used to provide the necessary strength without being too large. The size of any cable used is in no way intended to be limited to a specific size or grade. The handle 120 may have a permanent end 120A and removable end 120B. The permanent end 120A is fixed to the main body 110 while the removable end 120B may be secured to or removed from the main body 110. The removable end 120B may include a handle pin (not illustrated at this point for ease of illustration but will be discussed in more detail later) secured to handle 120 by swaging, or other means to provide a strong attachment. The handle pin may be used to secure the handle to the main body 110 and may include a plurality of detents as a means for securing.

The locking bag 100 may include a means, such as a sliding fastener (zipper) to open and close the opening in the main body 110. The two sides of the zipper (e.g., strips of interlocking teeth) that would be pulled together and interlocked when closed are not illustrated in the side view. The zipper may include a sliding head 130 that connects and secures the two sides of the zipper together or releases the two sides (depending on whether opening or closing the zipper). The zipper may also include a pull tab 132 connected to the sliding head 130 that can be grabbed by a user. The pull tab 132 may be rotatable around the sliding head 130 so that it can be used to pull the sliding head 130 in either direction. As illustrated, when the sliding head 130 is moved to the right (towards the removable end 120B) the zipper is closed and the main body 110 is sealed and when it is moved to the right (towards the permanent end 120A) the zipper is opened.

The locking bag 100 may include a locking mechanism 140 that may lock the removable end 120B of the handle 120 to the main body 110 and/or lock the zipper in a closed configuration. The locking mechanism 140 is simply illustrated as a box at this point for ease of illustration but will be discussed in more detail later. The locking mechanism 140 may be secured to the main body 110 using various means including but not limited to glue, sewing, screws, rivets, or cables. According to one embodiment, the locking mechanism 140 may be in a reinforcing panel (not illustrated) that is connected (e.g., sewn) to the main body 110.

Locking the removable end 120B of the handle 120 to the main body 110 enables the bag 100 to be secured to a variety of stationary or non-stationary objects (e.g. a tree, a table, a chair, a desk, a baby stroller, a shopping cart) by placing the handle 120 around the object prior to locking to the main body 110 via the locking mechanism 140. Locking the zipper in a closed configuration secures the contents of the main body 110 therewithin.

FIG. 1A illustrates the locking bag 100 in a configuration in which both the zipper and the handle 120 and secured in place (locked) by the locking mechanism 140. The XXXs in FIGS. 1A-D are to indicate that the zipper and accordingly the opening in the main body 110 are closed. This configuration could be used, for example, when you are carrying the bag 100 (e.g., using the handle to hold) or have the bag 100 secured to an object and want the contents of the main body 110 secured (locked).

Figure 1B:
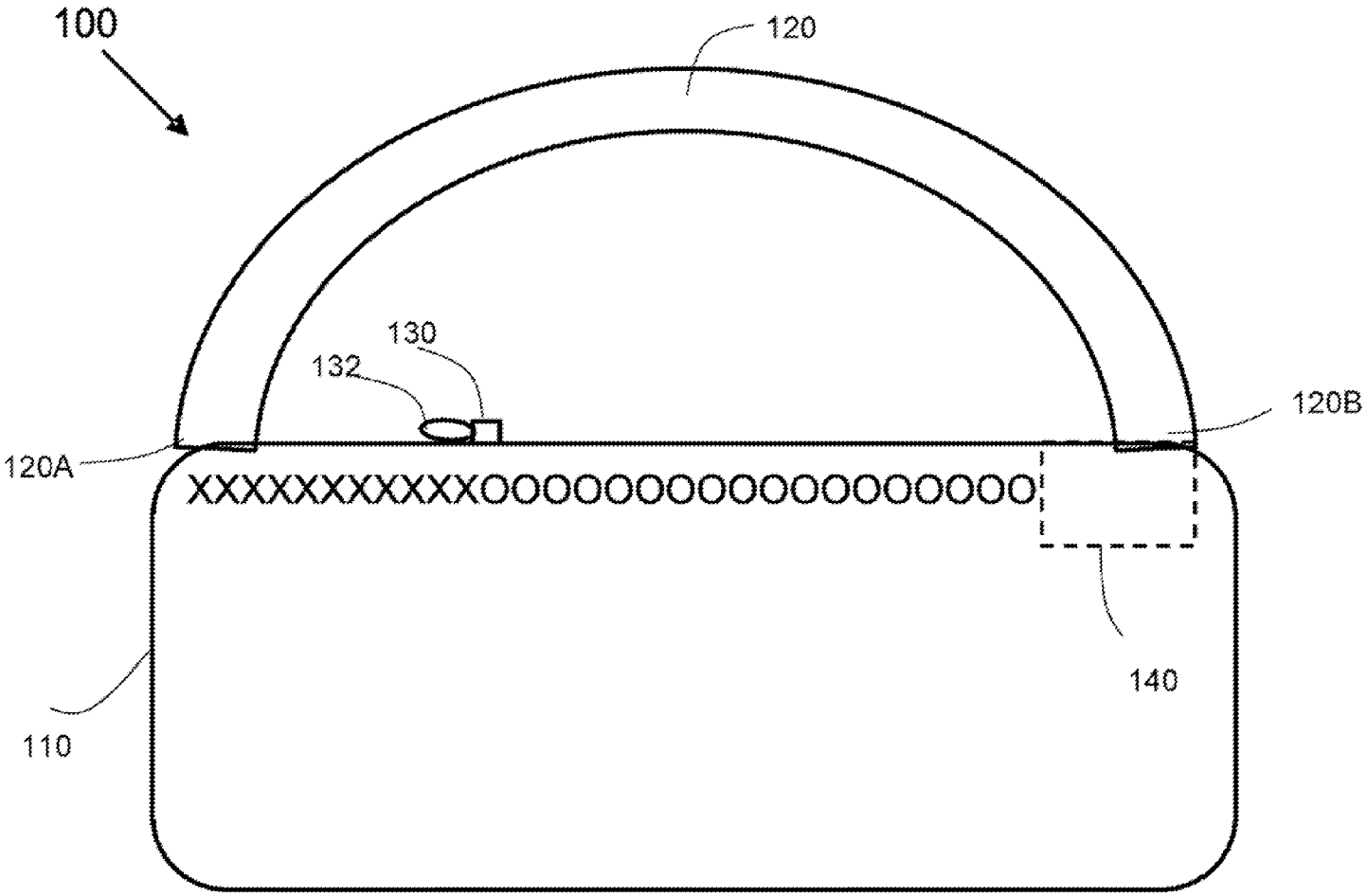

FIG. 1B illustrates the locking bag 100 in a configuration in which the zipper is unlocked and open while the handle 120 is secured in place (locked) by the locking mechanism 140. The OOOs in the FIGS. 1A-D are to indicate that the zipper is open and accordingly the opening in the main body 110 is open. This configuration could be used, for example, when you are carrying the bag 100 (e.g., using the handle to hold) and want access to the contents of the main body 110 or when you have the bag 100 secured to an object (e.g., stroller) but want access to the contents of the main body 110.

Figure 1C:
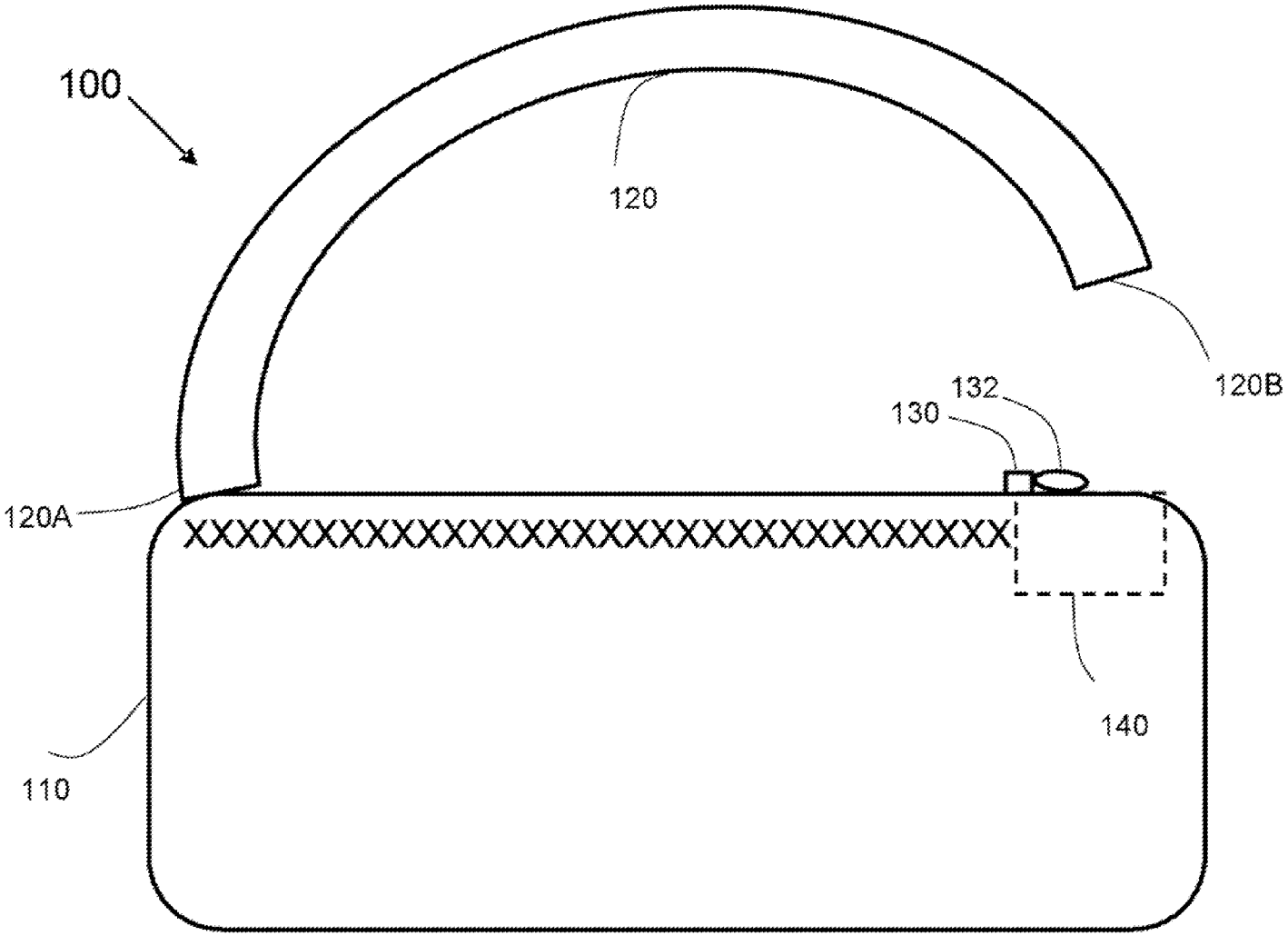

FIG. 1C illustrates the locking bag 100 in a configuration in which the zipper is closed and locked while the handle 120 is unsecured (removed from the main body 110). This configuration could be used, for example, when you want the contents of the main body 110 secured (locked) but do not need the handle to carry or lock the bag 100 to an object.

Figure 1D:
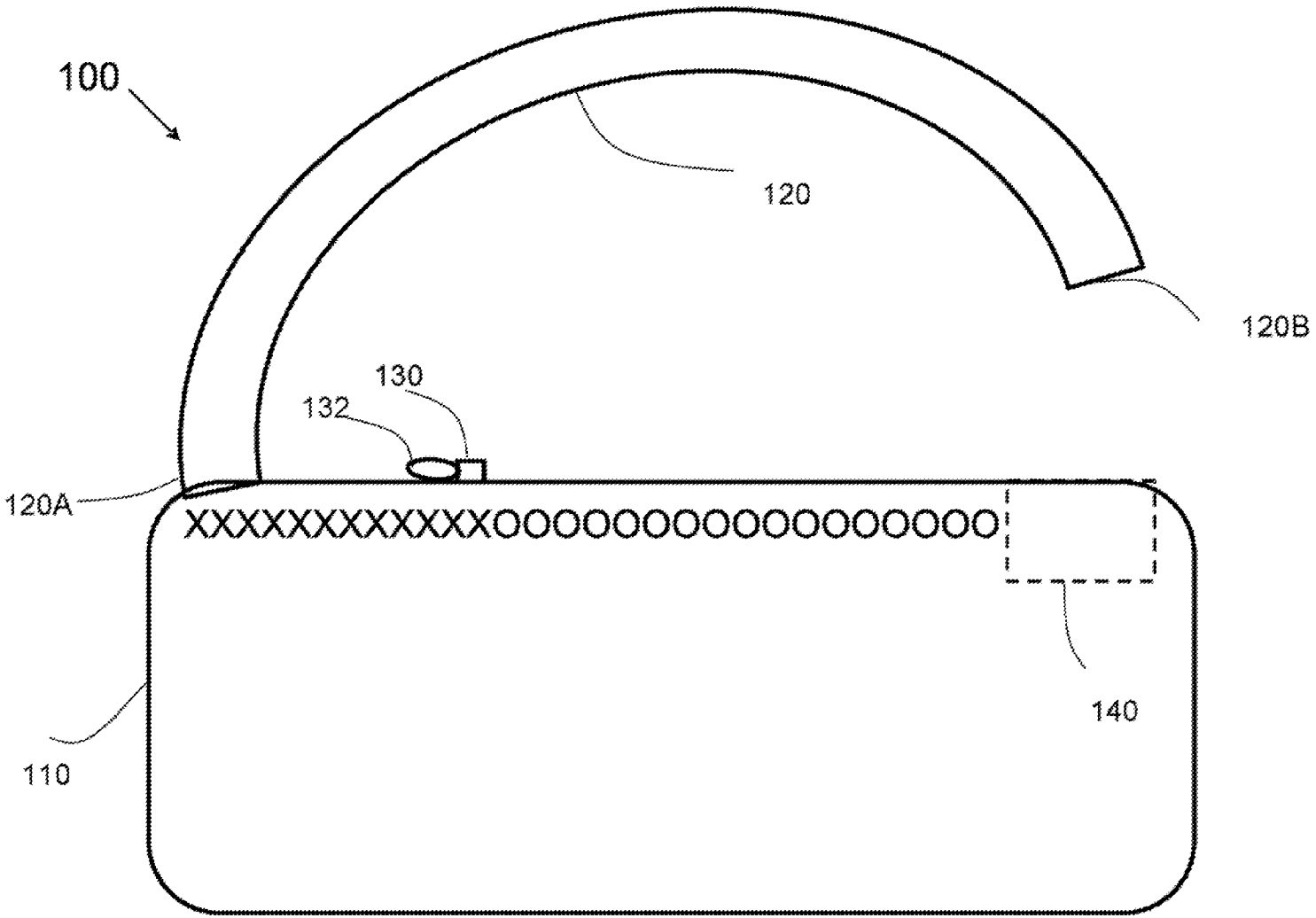

FIG. 1D illustrates the locking bag 100 in a configuration in which the zipper and the handle 120 are unlocked and the zipper is open and the handle 120 is removed from the main body 110. This configuration could be used, for example, when you don't need the handle to carry or secure the bag 100 to an object and when you want access to the main body 110 to put in or take out contents.

FIGS. 2A-B illustrate a simplified top and side view of an example locking mechanism 200 (e.g., 140 of FIGS. 1A-D). The locking mechanism 200 may be capable of securing a handle (e.g. 120A of FIGS. 1A-D), a zipper, or both to the main body (e.g., 110 of FIGS. 1A-D) by locking the zipper, the handle or both in place. The locking mechanism 200 may include a handle securing portion, a zipper securing portion, and a locking portion where the various portions engage and interact with one another to lock the zipper, the handle or both in place.

The handle securing portion of the locking mechanism 200 may include a pin housing 210 to secure a handle pin 292 of the handle 290 therein. The pin 292 may be inserted in the housing 210 through a pin port 212. The pin housing 210 may be a cam that includes teeth that when the cam is closed engage in indents with the pin 292 to lock the pin 292 in the housing 210. As illustrated the pin has two indents and the pin housing would include two sets of teeth to engage the indents. The number of indents and teeth is not limited to two. Preferably the number of indents and teeth would be greater than one for redundancy to ensure that a failure on one teeth indent pair would not result in the pin 292 dislodging from the pin housing 210 when not desired. The pin housing 210 and pin 292 are not limited to the illustrated embodiment.

The zipper securing portion of the locking mechanism 200 may include a zipper ledge 230 for receiving a zipper 280 (e.g., sliding head 130 or pull tab 132 of FIGS. 1A-D), and a fastener head 240 for securing the zipper 280 to the ledge 230. The fastener head 240 may be part of a shaft 250 that can be moved up and down within the locking mechanism 200. When the shaft 250 is moved down the fastener head 240 may secure the zipper 280 to the ledge 230 and when the shaft 250 is moved up the zipper 280 may be removed from the locking mechanism 200.

The locking portion of the locking mechanism 200 may include a lock 220, such as a key activated lock, and may include a key slot 222 to receive a key. The lock 220 may be a multiple pin tumbler (e.g., 7 pin) key-operated lock. The lock 220 may be located between the shaft 250 and the pin housing 210. The lock 220 may be used to secure (lock) the shaft 250 in a down position to secure the zipper to the zipper ledge 230 and/or the teeth of the pin housing within the indents of the pin 292 to secure the handle 290 therein. FIGS. 2A-B do not show the interaction between the pin housing 210, lock 220, and shaft 250 for ease of illustration. The interaction of these components will be discussed in more detail below.

FIGS. 3A-C illustrate a series of cross-sectional views of an example locking mechanism 300 (e.g., 140, 200) in use. The locking mechanism 300 may include a casing 310 that the various components are contained within. The locking mechanism 300 may include a pin housing 320 for receiving a pin 392 that is secured to the removable end of the handle 390. The pin housing 320 may be a cam that has teeth 322 formed on the interior walls that can be rotated and positioned by rotating the cam. The pin 392 may have indents 394 that the teeth 322 may be positioned to fit within when the pin 392 is in the pin housing rotated. When the teeth 322 are within the indents 394 the pin is secured in the housing. When the cam is rotated the other way the teeth 322 may be removed from the indents 394 so that the pin 392 can be removed from the housing 320. An arm (barrel paddle) 350 may connect to and rotate the pin housing 320 to engage and disengage the teeth 322 in the indents 394. A spring mechanism 324 may be included in the housing 320 or below the housing 320 and may be released when the pin housing 320 is rotated so that the teeth 322 and indents 394 are not engaged. The spring mechanism 324 may eject the pin 392 from the housing 320.

The locking mechanism 300 may include a lock 330. The lock 330 may be a key activated lock, such as a multiple pin tumbler (e.g., 7 pin). The lock 330 may include hook 332 on one end that is used to engage another component and lock the other component in place when the lock 330 is in a locked configuration.

The locking mechanism 300 may include a zipper locking shaft 340 for securing the zipper. The shaft 340 may include a main shaft 342, a thumb tab 344 extending from an upper edge of the main shaft 342 to secure the zipper, a groove 346 formed in the main shaft 342 for receiving the hook 332, and an engagement edge 348 formed in a lower edge of the main shaft 342 to engage arm 350.

FIG. 3A illustrates the locking mechanism 300 in a configuration where the zipper and the handle could be locked if they were inserted accordingly. The pin housing 320 is rotated such that the teeth 322 and within the indents 394. The hook 332 is engaged with the groove 346 so that the shaft 340 is locked in a down configuration where the zipper (not illustrated) could be secured under the thumb tab 344.

FIG. 3B illustrates the locking mechanism 300 in a configuration where the zipper may be released. The lock 330 was unlocked and rotated, for example in the direction R1, so that the hook (not illustrated as it may be protruding out of FIG.) is no longer engaged with the groove 346. As the shaft 340 is no longer locked in place it may be moved upward, for example in the direction U1, so that the thumb tab 344 is lifted from the housing 310 and the zipper can be removed. In addition, the engagement edge 348 is now in communication with the arm 350 and can engage and move the arm 350.

FIG. 3C illustrates the locking mechanism 300 in a configuration where the pin 392 may be released (or ejected) from the pin housing 320. The shaft 340 was rotated, for example in the direction R2, so that the engagement edge causes the arm 350 to move in a manner that causes the pin housing to rotate so that the teeth 322 and no longer engaged within the indents 394. The shaft 340 may be rotated using the thumb tab (not illustrated as it may be protruding out of FIG.). The rotating of the shaft may also enable the spring 324 to be activated and cause the pin to be ejected.

For the sake of clarity, FIGS. 3A-C do not illustrate all details associated with the operation of the locking mechanism 300. Furthermore, the locking mechanism 300 and the various components of the locking mechanism 300 are not limited to the illustrated embodiments. One skilled in the art would recognize that changes could be made without departing from the current scope.

FIG. 4 illustrates an exploded view of an example locking mechanism 400 (e.g., 140, 200, 300). The locking mechanism 400 may include upper and lower housing 410, 412. An upper edge of the upper housing 410 may include a first hole 414 for receiving a pin 416, a second hole 418 for receiving a lock 420, a zipper ledge 422 for receiving a zipper (not illustrated), and a hole (not illustrated) within the zipper ledge 422 for receiving a zipper locking shaft 424. A spring 426 may be utilized on the zipper locking shaft 424. A pin housing 430 may be located within the housings 410, 412 in alignment with the first hole 414. An arm 432 may be configured to communicate with the zipper locking shaft 424 in an upward position and may be controlled thereby. The arm 432 may rotate the pin housing 430 to enable the teeth therewithin to engage or disengage the indents in the pin 416. A spring 434 may be used to eject the pin 416.

FIG. 5 illustrates a side views of an example locking bag 500 in a locked configuration. The locking bag 500 includes a main body 510, a handle 520, a zipper (only a sliding head 530 and pull tab 532 illustrated) and a locking mechanism 540 to secure (lock) the handle 520 to the main body 510 and/or lock the zipper in a closed configuration. The locking bag 500 may include a cable 550 that is included in the handle 520 as well as the main body 510. A first end 552 of the cable 550 may be permanently secured to the locking mechanism 540 and a second end 554 may be removably connected and locked to the locking mechanism 540. The use of the cable throughout the bag 500 provides for additional security by reinforcing the attachment of handle 520 to the main body pouch 510.

According to one embodiment, the cable 550 within the main body 510 may be woven though contents 560 within the main body 510 to further secure the contents (e.g., a computer, a gun) 560 therein. The first end 552 of the cable 550 may also be removably connected and secured to the locking mechanism 540 rather then permanently connected to enable the cable to be woven through the contents 560.

FIGS. 6A-C illustrate cross-sectional views of example locking mechanisms. FIG. 6A illustrates a locking mechanism 600 wherein a zipper locking shaft 605 and a lock 610 are on the top of the locking mechanism 600 while a pin housing 615 is on the side. This embodiment enables the cable to be inserted from the side rather than the top. FIG. 6B illustrates a locking mechanism 620 wherein a zipper locking shaft 625 is located on the top of the locking mechanism 620 while a lock 630 and a pin housing 635 are on the side. This embodiment enables the cable to be inserted and the device to be locked from the side rather than the top. FIG. 6C illustrates a locking mechanism 640 wherein a zipper locking shaft 645 and a pin housing 650 are located on the top of the locking mechanism 620 while a lock 655 is on the side. This embodiment enables the device to be locked from the side rather than the top. The exact details regarding the interaction of the devices may vary.

FIG. 7 illustrates a top cross sectional view of an example locking mechanism 700. The locking mechanism 700 may include a lock 710, a zipper locking shaft 720 and a pin housing 730. The lock 710 may include a key slot 712 and flanges 714, 716 on each side thereof. The zipper locking shaft 720 may include a groove 722 formed therein. The pin housing may include an arm 732 connected thereto. A key may be inserted in the lock 710 and enable the lock 710 to move in either direction and enable the user can to unlock either the handle or the zipper depending on which way the key is turned. When the key is turned to the right (direction indicated by arrow labeled "R") the flange 714 that was within the groove 722 may disengage from the groove 722 and enable shaft 720 to move (e.g., upwards). When the key is turned to the left (direction indicated by arrow labeled "L") the flange 716 may engage the arm 732 causing the housing 730 to rotate and the teeth to disengage the indents and enable the handle to be removed. With this embodiment, the user can conveniently unlock the fastener head separately from the handle. If the user desires to unlock both the fastener head and the handle, this can be easily achieved by turning the key in one direction, followed by the opposite direction. For example, by turning the key right, and then left, both the fastener head and the handle are conveniently released.

Although the invention has been illustrated by reference to specific embodiments, it will be apparent that various changes and modifications may be made. Reference to "one embodiment" or "an embodiment" means that a particular feature, structure or characteristic described in connection with the invention is included in at least one embodiment. Thus, the appearances of the phrase "in one embodiment" or "in an embodiment" appearing in various places throughout the specification are not necessarily all referring to the same embodiment.

It will be understood that the present invention may have various other embodiments. Furthermore, while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed. Thus, the scope of the invention should be determined by the appended claims and their legal equivalents, rather than solely by the examples given. The invention is intended to be protected broadly within the spirit and scope of the appended claims.

What is claimed is:

1. A locking bag comprising:

a main body forming at least one compartment for holding contents and having an opening;

a sliding fastener, comprising a sliding fastener head, configured and disposed to open and close the opening of the main body;

a handle having a first end and a second end, the first end permanently secured to the main body, and the second end removably secured to the main body, the second end having a handle pin;

a locking mechanism to lock the sliding fastener in a closed configuration and to lock the handle to the main body;

wherein the locking mechanism includes a pin housing, a lock, and a sliding fastener locking shaft;

wherein the sliding fastener locking shaft includes a thumb tab and a sliding fastener edge, and wherein the sliding fastener head is secured between the thumb tab and the sliding fastener edge; and wherein the sliding fastener locking shaft further includes a main shaft that the thumb tab extends therefrom, wherein the main shaft is to move up and down to release and engage the thumb tab from the sliding fastener edge.

2. The locking bag of claim 1, wherein the lock includes a hook and the main shaft includes a groove, and wherein when the hook is locked within the groove the sliding fastener locking shaft is locked in place in a down position.

3. The locking bag of claim 1, wherein the sliding fastener further comprises a pull tab attached to the sliding fastener head.

4. The locking bag of claim 1, wherein the sliding fastener is a zipper.

5. The locking bag of claim 1, wherein the handle includes a cable.

6. The locking bag of claim 5, wherein the cable is comprised of steel.

7. The locking bag of claim 5, wherein the cable is coated with plastic.

8. The locking bag of claim 1, wherein the handle extends into the interior of the main body.

9. The locking bag of claim 1, wherein the main body is comprised of polyester fabric.

10. The locking bag of claim 1, wherein the handle pin includes indents and the pin housing includes teeth that engage the indents to secure the pin in the pin housing.

11. The locking bag of claim 10, wherein the sliding fastener locking shaft includes an engaging edge that engages an arm to rotate the pin housing to engage or disengage the teeth within the indents.

12. A locking bag comprising:

a main body forming at least one compartment for holding contents and having an opening;

a sliding fastener, comprising a sliding fastener head, configured and disposed to open and close the opening of the main body;

a handle having a first end and a second end, the first end permanently secured to the main body, and the second end removably secured to the main body, the second end having a handle pin; and a locking mechanism to lock the sliding fastener in a closed configuration and to lock the handle to the main body, wherein the locking mechanism includes a pin housing, a lock, and a sliding fastener locking shaft, wherein the sliding fastener locking shaft includes a thumb tab and a sliding fastener edge to secure the sliding fastener head therebetween, wherein the sliding fastener locking shaft further includes a main shaft that the thumb tab extends therefrom, wherein the main shaft is to move up and down to release and engage the thumb tab from the sliding fastener edge, wherein the lock includes a hook and the main shaft includes a groove, and wherein when the hook is locked within the groove the sliding fastener locking shaft is locked in place in a down position.

13. The locking bag of claim 12, wherein the handle pin includes indents and the pin housing includes teeth that engage the indents to secure the pin in the pin housing.

14. The locking bag of claim 13, wherein the sliding fastener locking shaft includes an engaging edge that engages an arm to rotate the pin housing to engage or disengage the teeth within the indents.

15. The locking bag of claim 13, wherein the lock includes an engaging edge that engages an arm to rotate the pin housing to engage or disengage the teeth within the indents.

16. The locking bag of claim 12, wherein the sliding fastener is a zipper.

17. The locking bag of claim 12, wherein the handle is comprised of a cable.

* * * * *